US007906742B2

(12) United States Patent
Steffens et al.

(10) Patent No.: US 7,906,742 B2
(45) Date of Patent: Mar. 15, 2011

(54) VACUUM INTERRUPTER CHAMBER AND CONTACT ARRANGEMENT FOR A VACUUM CIRCUIT BREAKER

(75) Inventors: Alexander Steffens, Langenfeld (DE); Dietmar Gentsch, Bochum (DE); Kaveh Niayesh, Tehran (IR)

(73) Assignee: ABB Research Ltd., Zurich (CH)

( * ) Notice: Subject to any disclaimer, the term of this patent is extended or adjusted under 35 U.S.C. 154(b) by 669 days.

(21) Appl. No.: 11/631,576

(22) PCT Filed: Jun. 22, 2005

(86) PCT No.: PCT/CH2005/000348

§ 371 (c)(1),
(2), (4) Date: Oct. 9, 2007

(87) PCT Pub. No.: WO2006/002560

PCT Pub. Date: Jan. 12, 2006

(65) Prior Publication Data

US 2008/0067151 A1 Mar. 20, 2008

(30) Foreign Application Priority Data

Jul. 5, 2004 (EP) ..... 04405417

(51) Int. Cl.
*H01H 33/66* (2006.01)

(52) U.S. Cl. ..... 218/126; 218/123

(58) Field of Classification Search ..... 218/118–120, 218/123–127, 140–143, 146, 154, 155
See application file for complete search history.

(56) References Cited

U.S. PATENT DOCUMENTS

| | | | | |
|---|---|---|---|---|
| 4,210,790 | A * | 7/1980 | Kurosawa et al. | 218/127 |
| 5,929,409 | A * | 7/1999 | Zehnder et al. | 218/48 |
| 6,674,039 | B1 * | 1/2004 | Banghard et al. | 218/123 |

FOREIGN PATENT DOCUMENTS

| | | |
|---|---|---|
| DE | 1196751 | 7/1965 |
| GB | 997384 | 7/1965 |
| GB | 1145151 | 3/1969 |
| WO | 2006002560 | 1/2006 |

* cited by examiner

*Primary Examiner* — Renee Luebke
*Assistant Examiner* — Marina Fishman
(74) *Attorney, Agent, or Firm* — Paul R. Katterle

(57) ABSTRACT

The invention relates to a contact arrangement for a vacuum interrupter chamber (1), which comprises a pair of inner contact pieces (11, 12), configured as RMF contact pieces, and a pair of outer contact pieces (21, 22) which are connected in parallel and are mounted closely adjacent to the inner contact pieces (11, 12). At least one of the inner contact pieces (11, 12) is movably mounted. The outer contact pieces (21, 22) are also configured as RMF contact pieces. During interruption, the resulting electric arc can commutate completely or partially to the pair of outer contact pieces (21, 22). The inner contact pieces are substantially discoid. Advantageously, the contact pieces (11, 12, 21, 22) are coaxially positioned in relation to each other. The outer contact pieces (21, 22) are advantageously pot-shaped or tubular.

11 Claims, 3 Drawing Sheets

VACUUM INTERRUPTER CHAMBER AND CONTACT ARRANGEMENT FOR A VACUUM CIRCUIT BREAKER

TECHNICAL FIELD

The invention relates to the field of switch technology, in particular to high-voltage and medium-voltage switch technology. It relates to a contact arrangement for a vacuum interrupter chamber, and to a vacuum interrupter chamber and a switching device.

PRIOR ART

A contact arrangement such as this and a vacuum interrupter chamber such as this are known, for example, from Laid-Open Specification DE 197 05 158 and from the U.S. Pat. No. 4,847,456, in each of which a vacuum interrupter chamber is formed with a pair of inner contact pieces, which are in the form of RMF contact pieces, and a pair of outer contact pieces. The outer contact pieces are connected electrically in parallel, and are arranged physically closely adjacent to the inner contact pieces. One of the inner contact pieces is mounted such that it can move, while the other contact pieces are stationary. The outer contact pieces are in the form of AMF contact pieces. During a disconnection process, a contracting, rotating arc is struck between the inner contact pieces and is then commutated from the inner to the outer contact pieces. This results in the initially contracting arc being changed to a diffuser which burns between the AMF contact pieces until it is quenched.

This results in the vacuum interrupter chamber having a disconnection rating which is greater than that of a vacuum interrupter chamber which has only one pair of RMF contact pieces.

A further increase in the switching rating or a comparable switch size is desirable. In particular, a high short-circuit current disconnection capability is desirable.

Further prior art:

DE 1 196 751 discloses a contact arrangement for a vacuum circuit breaker having in each case one pair of slotted contact pieces in the form of pots, with the pot base of the inner contact piece which is in the form of pot being a part of the pot base of the outer contact piece which is in the form of a pot. The inner and outer contact pieces are physically well apart from one another (at their upper pot edges).

DE 199 34 909 C1 (FIGS. 6 and 7) discloses a contact arrangement for a vacuum interrupter chamber, in which slotted tubular pieces are provided as inner contact pieces and outer contact pieces. The inner tubular contact pieces are slotted in such a manner that this results in sprung contact tongues being formed. The aim of this is to create a large number of separate mechanical contact points with a defined spring constant. In a further embodiment (FIGS. 4 and 5), an additional contact piece is also arranged within the inner spring contact piece, is intended to carry operating currents, and by means of which low contact resistances can be achieved. When the switch is opened, the additional contact piece is lifted off first of all. The increase in resistance which is associated with this and the additional contact piece then results in the current flowing through the inner sprung contact piece. Once the inner sprung contact piece has been lifted off, an arc is then formed.

GB 1 145 451 discloses a contact arrangement for a vacuum interrupter chamber having three pairs of slotted contact pieces which are arranged one inside the other and are in the form of pots. The contact piece pairs are intended to be designed such that, during disconnection of the two contact pieces, of each of the three contact piece pairs, an arc is in each case struck, and these three arcs then rotate between the two contact pieces of the respective contact piece pair, and in a corresponding manner each form an essentially cylindrical arc curtain.

DE 30 09 925 discloses a contact arrangement for a vacuum interrupter chamber having two slotted contact pieces which are in the form of pots and are arranged one inside the other. A non-slotted ring is arranged between the pot walls of the contact pieces which are in the form of pots. This results in the contact pieces having greater mechanical strength. The electrical conductivity of the ring material (stainless steel) is considerably lower than that of the contact piece material (copper). The arc rotation is not weakened by the non-slotted ring.

DESCRIPTION OF THE INVENTION

The object of the invention is therefore to provide a contact arrangement and a vacuum interrupter chamber of the type mentioned initially, which allow an increased switching rating. In particular, the aim is to achieve a high short-circuit disconnection capacity with a high arc burning voltage.

The contact arrangement is intended to have a low resistance and to be able to carry high currents.

A contact arrangement according to the invention for a vacuum interrupter chamber has a pair of inner contact pieces which are in the form of RMF contact pieces, and a pair of outer contact pieces. The outer contact pieces are connected electrically in parallel with the inner contact pieces, and are arranged physically closely adjacent to the inner contact pieces. At least one of the inner contact pieces is mounted such that it can move. The outer contact pieces are in the form of RMF contact pieces. The inner contact pieces are essentially in the form of disks. The inner and the outer contact pieces are arranged and designed in such a manner that an arc which is struck during a disconnection process between the inner contact pieces can be commutated entirely or partially between the outer contact pieces.

An RMF contact has the major advantage over a AMF contact that the current path resistance of the vacuum interrupter chamber is at a lower level when the contact pressure force is high (up to several thousand Newtons). If the axial magnetic field of the AMF contact is produced by the flowing current, the inductance is high. If the axial magnetic field of the AMF contact is produced by permanent magnets, this results in large eddy-current losses.

A further major advantage of RMF contacts over AMF contacts is their higher arc voltage. The arc voltage of RMF contacts may be more than 100 V and up to 150 V, while the arc voltage of AMF contacts is typically only 30 V to 50 V, and in any case considerably less than 100 V.

In a vacuum interrupter chamber according to the invention, the arc which is struck during a disconnection process can commutate entirely or partially onto the outer contact piece pair. Whether one or two arcs burn depends on the current level. After disconnection of the initially touching contact pieces on load, a concentrated disconnection arc occurs first of all. As the contact pieces open further, a contracted arc column is formed between the contact pieces in the case of an RMF contact. As the contact separation increases further during the course of the disconnection process, partial commutation occurs or, with an appropriate physical design, complete commutation. If the arc (which has been struck between the inner contact pieces) commutates completely onto the outer contact pieces, then the interrupter chamber according to the invention can carry and switch at least the same current as the interrupter chamber with only one RMF contact piece pair. If the outer contact pieces are not in the form of rated current contact pieces, that is to say they do not touch when the switch is closed, this results in an improved switching rating, since the arc then rotates on a mechanically and thermally unloaded surface with little roughness depth, after commutation onto the outer contact pieces.

The situation with partial commutation is different: in comparison to a vacuum interrupter chamber with only one contact piece pair and accordingly only one arc, the existence of two arcs in the interrupter chamber has the advantage that considerably greater currents can be carried and disconnected, because a considerably larger area is used as the erosion area. Partial commutation takes place predominantly with high currents. This thus allows reliable disconnection of high (short-circuit) currents.

The closely adjacent arrangement of in each case one inner and one outer contact piece ensures that an arc which is struck between the inner contact pieces can strike an arc between the outer contact pieces, thus allowing (partial) commutation.

Since the inner contact pieces are (essentially) in the form of disks, this makes it possible to achieve a low contact arrangement resistance, and high currents can be carried.

The contact pieces are advantageously designed to be essentially rotationally symmetrical, and are in general provided with slots in order to produce the radial magnetic field. The literature discloses various possible ways to form slots such as these and corresponding contact piece sickles. In the case of the inner contact pieces, slots are advantageously provided only in the radially outer area. The outer contact pieces are advantageously provided with a non-slotted coating composed of erosion-resistant material.

The contact pieces are advantageously arranged coaxially with respect to one another.

The outer contact pieces are advantageously tubular or in the form of pots. In each case one inner contact piece is advantageously arranged within in each case one outer contact piece.

If only one of the two inner contact pieces can be moved, the second, stationary inner contact piece is advantageously attached to a stationary contact stalk.

The two outer contact pieces may be arranged to be stationary or moving. It is particularly advantageous for either both outer contacts to be stationary or for one of them to be stationary while the other can move. In the latter case, the movement of the moving outer contact piece is advantageously coupled to the movement of the moving inner contact piece, advantageously by means of a rigid connection between the two moving contact pieces.

The inner contact pieces are advantageously used as rated current contacts. Particularly in the situation in which in each case one inner and outer contact piece is arranged such that it can move, and these are rigidly connected to one another, the moving inner contact piece advantageously overhangs the moving outer contact piece in the axial direction. It is also possible to use both the inner and the outer contact pieces as rated current contacts.

It is highly advantageous for the contact arrangement to be in the form of a fixed soldered contact system.

A high switching rating can be achieved if a contact arrangement according to the invention and a vacuum interrupter chamber according to the invention have small dimensions. Very high short-circuit currents can be reliably interrupted, and high rated currents can be carried.

A vacuum interrupter chamber according to the invention can advantageously be provided in a switching device; in particular in a switching device with small dimensions, since a vacuum interrupter chamber according to the invention can have smaller dimensions than conventional vacuum interrupter chambers with a comparable disconnection capacity. A switching device such as this may, of course, be a vacuum circuit breaker. However, the switching device can also advantageously be a circuit breaker or a high-power circuit breaker and, in particular, may be a generator switch, with the switching device containing at least one vacuum interrupter chamber, which is typically a component of a vacuum circuit breaker.

Further preferred embodiments and advantages will become evident from the dependent patent claims and from the figures.

BRIEF DESCRIPTION OF THE DRAWINGS

The subject matter of the invention will be explained in more detail in the following text with reference to preferred exemplary embodiments, which are illustrated in the attached drawings, in which, schematically.

Figure 1:
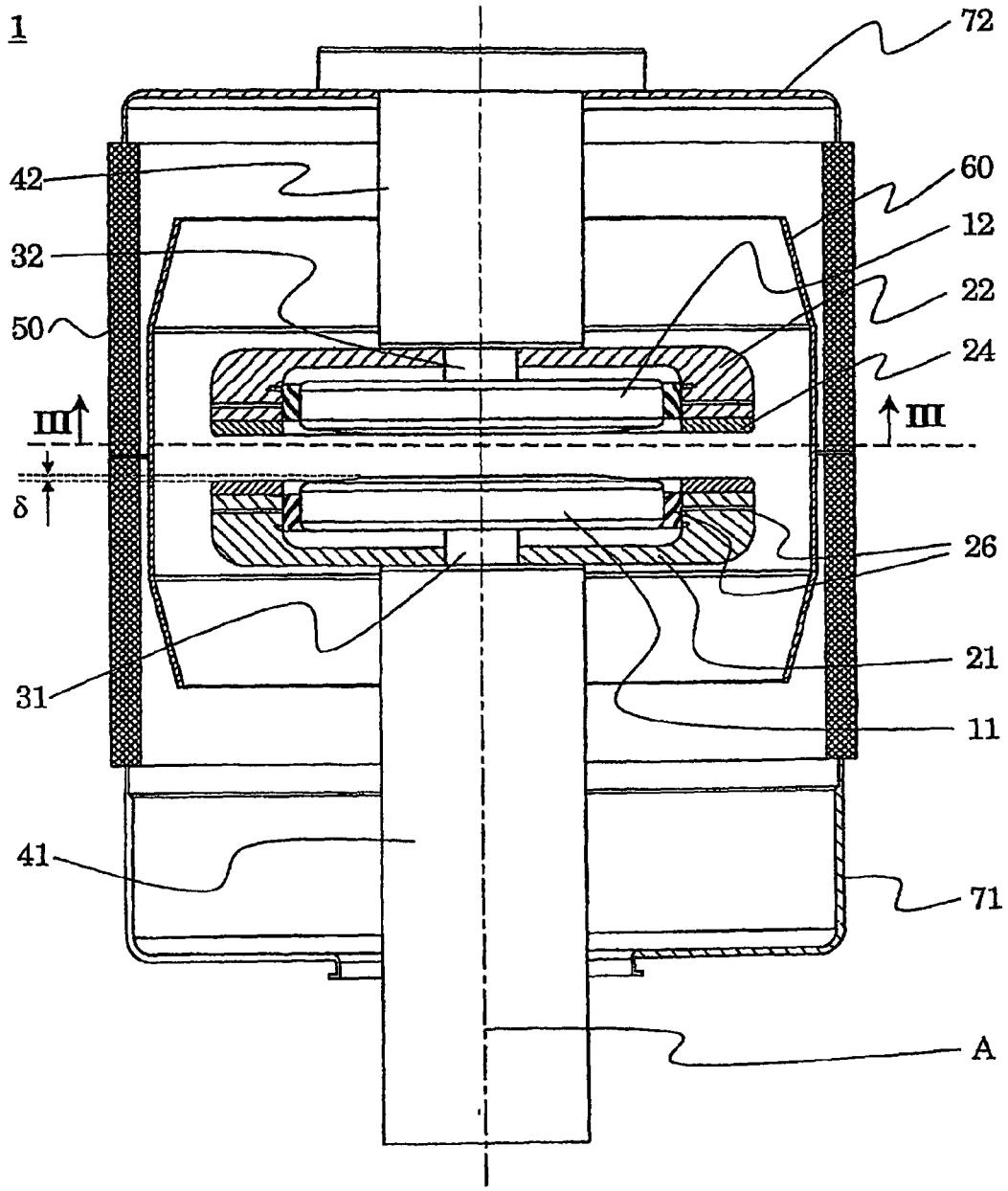
FIG. 1 shows a partial section through a vacuum interrupter chamber according to the invention having a moveable outer contact piece.

The reference symbols used in the drawings and their meanings are listed in a summarized form in the list of reference symbols. In principle, identical parts or parts having the same effect are provided with the same reference symbols in the figures. The described exemplary embodiments represent examples of the subject matter of the invention, and have no restrictive effect.

APPROACHES TO IMPLEMENTATION OF THE INVENTION

FIG. 1 shows, schematically and in the form of a partial section, a vacuum interrupter chamber 1 according to the invention in the open state. Details which are not significant to the invention are not discussed, and, largely, are not illustrated.

The vacuum interrupter chamber 1 is essentially rotationally symmetrical with an axis A and includes an inner contact piece pair 11, 12 and an outer contact piece pair 21, 22. The two contact pieces 11 and 21 are mounted such that they can move, while the two contact pieces 12 and 22 are stationary. The outer contact pieces 21, 22 are provided with slots 26, so that they form an RMF contact piece pair. Thus, when a current is flowing through the contact pieces 21, 22, a radially running magnetic field is produced. The inner contact pieces 11, 12 are also in the form of RMF contact pieces and are provided with slots for this purpose, although these are not illustrated in FIG. 1.

The moving contact pieces 11 and 12, which are essentially in the form of disks, are attached to a moving contact stalk 41 by means of a pin 31. The stationary contact pieces 12 and 22 are attached to a stationary contact stalk 42 by means of a pin 32.

The described metallic contact arrangement is part of the vacuum interrupter chamber 1, which has an insulating body 50, typically composed of ceramic, which is designed to be hollow-cylindrical and is closed by a respective cover 71; 72 at each of its ends. The moving contact stalk 41 is passed through the cover 71 and is attached to it with the interposition of a bellows, which is not illustrated in FIG. 1. The stationary contact stalk 42 is attached to the cover 72. A shield 60 prevents the insulating body 50 from losing its insulating characteristics, and becoming electrically conductive, as a result of vaporization, in particular with metal vapor from the arc zone between the contact piece pairs 11, 21 and 12, 22.

The inner contact pieces 11, 12 are composed on the side with which they face one another of an erosion-resistant material, for example Cu/Cr. The outer contact pieces 21, 22 are also provided on the side with which they face one another with a coating 24 composed of an erosion-resistant material. This coating 24 is not provided with slots, but forms an unslotted ring.

The outer contact pieces 21, 22 are in the form of pots or cups and each contain one of the inner contact pieces 11, 12. The respective pin 31; 32 passes through the pot base or cup base, and is advantageously not slotted. The configuration of the pins 31, 32 and of the pot base or cup base, as well as the inner contact pieces 11, 12 and of the outer area of the outer contact pieces 21, 22, and the coupling to the contact stalks 41, 42 makes it possible to influence the way in which the current is split between the two contact piece pairs 11, 12; 21, 22, so that suitable partial commutation or full commutation occurs in appropriate switching situations.

The moving inner contact piece 11 overhangs the ring which is formed by the coating on the contact piece 21, in the axial direction by a distance δ. The outer contact pieces 21, 22 do not touch in the closed state, but only the inner contact pieces. The inner contact pieces 11, 12 are thus used as rated current contacts for the vacuum interrupter chamber 1 shown in FIG. 1. Alternatively or additionally, the inner contact piece 12 can also overhang the ring which is formed on the coating 24, by a distance in the axial direction.

An arc is struck between the inner contact pieces 11, 12 on disconnection of the contacts of the vacuum interrupter chamber 1. Since the inner contact pieces 11, 12 are in the form of RMF contact pieces, the arc will first of all rotate, because of the radial magnetic field, in the radially outer area between the inner contact pieces 11, 12 as a contracting arc. Depending on the magnitude of the current flowing, full commutation or partial commutation of the arc can then take place from the inner contact pieces to the outer contact pieces as a result of the short radial distance between the inner and outer contact pieces. The arc which then burns between the outer contact pieces 21, 22 will then likewise rotate as a contracting arc, since the outer contact pieces 21, 22, as RMF contact pieces, produce a radial magnetic field.

Figure 2:
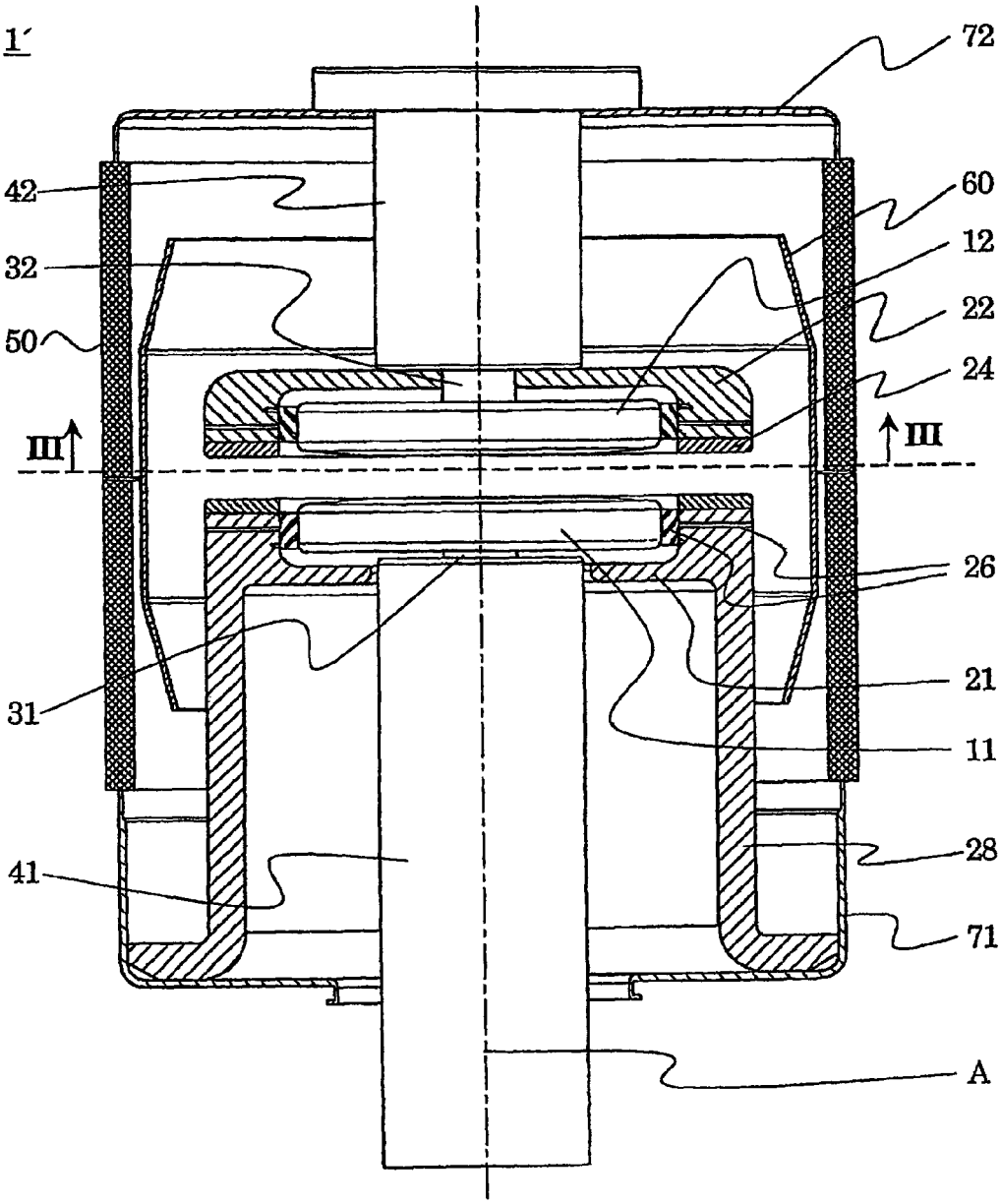
FIG. 2 shows a partial section through a vacuum interrupter chamber according to the invention having two stationary outer contact pieces.

FIG. 2 shows a further advantageous embodiment of the invention which largely corresponds to the embodiment illustrated in FIG. 1, and will be described on this basis.

In FIG. 2, both outer contact pieces 21, 22 of the vacuum interrupter chamber 1' are stationary contact pieces. The outer contact piece 22 is predominantly tubular, with a connection 28 to the cover 71, which at the same time acts as a contact mount 28. During a switching process, the distance between the two outer contact pieces 21, 22 does not change. In this case as well, the inner contact pieces 11, 12 are the rated current contacts. In this case, it is possible, but not necessary (as illustrated), for the inner contact piece 11 to overhang the outer contact piece 21 in the disconnected state.

The mass which has to be moved during a switching process is less in the case of a vacuum interrupter chamber 1' as shown in FIG. 2 than in the case of a vacuum interrupter chamber 1 as shown in FIG. 1.

The two vacuum interrupter chambers 1, 1' which are illustrated in FIGS. 1 and 2 are designed in such a manner that they can be soldered in a final soldering process. This results in a firmly soldered contact arrangement.

Figure 3:
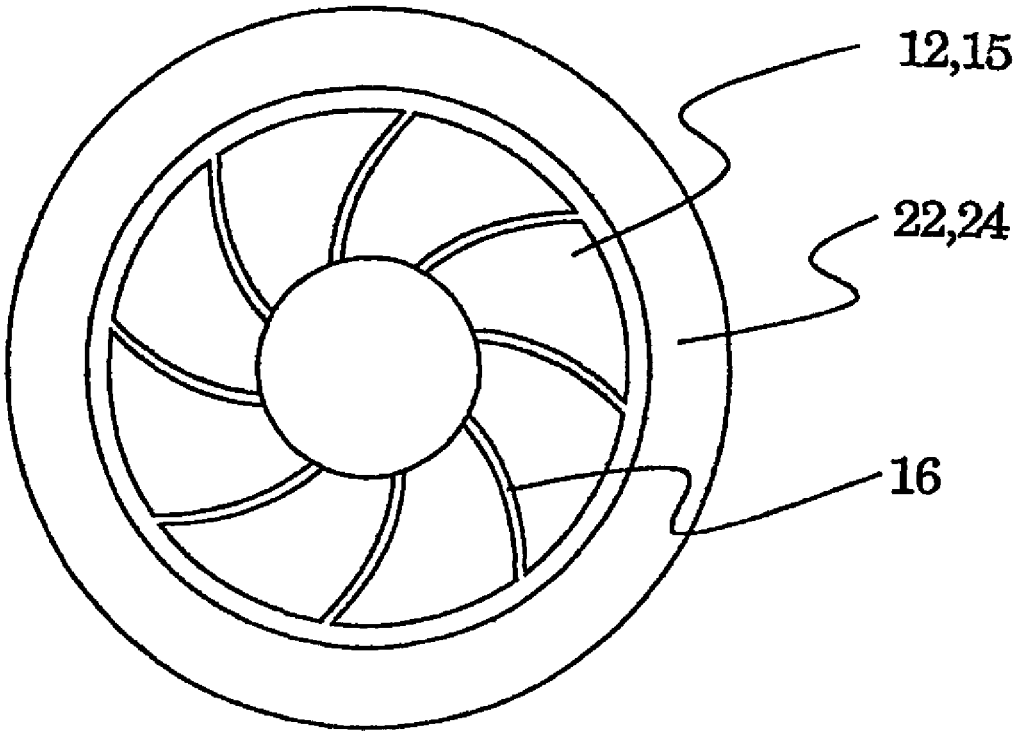
FIG. 3 shows a plan view of an inner and an outer contact piece.

FIG. 3 shows a plan view of an inner contact piece 12 and of an outer contact piece 22 along the plane annotated III in FIGS. 1 and 2. The outer contact piece 22 is arranged concentrically around the inner contact piece 12, which is provided with slots 16. The slots 16 result in a large number of contact sickles 15 on the inner contact piece 12. Since the outer contact piece 22 is provided with the annular, unslotted coating 24, the slots which are located underneath it in the contact piece 22 cannot be seen in FIG. 3.

LIST OF REFERENCE SYMBOLS

1, 1' Vacuum interrupter chamber
11 Inner contact piece, moving inner contact piece
12 Inner contact piece, stationary inner contact piece
15 Contact sickle
16 Slot
21 Outer contact piece
22 Outer contact piece, stationary outer contact piece
24 Coating composed of erosion-resistant material
26 Slot
28 Connection, tubular supply line, contact mount
31 Pin
32 Pin
41 Contact stalk, moving contact stalk
42 Contact stalk, stationary contact stalk
50 Insulating body, insulating tube, ceramic
60 Shield
71 Cover
72 Cover
A Axis, rotation axis
δ Distance

The invention claimed is:

1. A contact arrangement for a vacuum interrupter chamber (1), the contact arrangement comprising:

a pair of inner contact pieces (11, 12) which are configured as radial magnetic field contact pieces, and a pair of outer contact pieces (21, 22) which are arranged adjacent to the inner contact pieces (11, 12), respectively, and are connected electrically in parallel with them, the outer contact pieces being disposed radially outward from the inner contact pieces, wherein at least one of the inner contact pieces (11) is mounted such that it can move, wherein the inner contact pieces (11, 12) are substantially disc-shaped, wherein the outer contact pieces (21, 22) are-configured as radial magnetic field contact pieces, wherein the inner contact pieces (11, 12) and the outer contact pieces (21, 22) are arranged and designed in such a manner that an arc which is struck during a disconnection process between the inner contact pieces (11, 12) can be commutated entirely or partially between the outer contact pieces (21, 22), and wherein one of the inner contact pieces has a coating thereon and is configured so as to extend beyond its associated outer contact piece in an axial direction by a thickness of the coating; and wherein the other one of the inner contact pieces is configured so as to be disposed flush with its associated outer contact piece in an axial direction.

2. The contact arrangement as claimed in claim 1, wherein the inner contact pieces (11, 12) and the outer contact pieces (21, 22) are arranged coaxially with respect to one another.

3. The contact arrangement as claimed in claim 1, wherein the outer contact pieces (21, 22) are pot-shaped.

4. The contact arrangement as claimed in claim 1, wherein each inner contact piece (11; 12) is arranged within its associated outer contact piece (21; 22).

5. The contact arrangement as claimed in claim 1, wherein one of the inner contact pieces (12) is attached to a stationary contact stalk (42).

6. The contact arrangement as claimed in claim 1, wherein at least one of the outer contact pieces (21) is mounted such that it can move.

7. The contact arrangement as claimed in claim 1, wherein the inner contact pieces (11, 12) and/or the outer contact pieces (21, 22) are provided with radially and axially running slots (26) in order to produce a radial magnetic field when a current flows through the inner contact pieces (11, 12) and/or through the outer contact pieces (21, 22).

8. The contact arrangement as claimed in claim 7, wherein the two outer contact pieces (21, 22) are provided with a coating (24) composed of erosion-resistant material, with the coating (24) having no slots.

9. A vacuum interrupter chamber (1; 1') which contains a contact arrangement as claimed in claim 1.

10. A switching device, comprising at least one vacuum interrupter chamber (1; 1') as claimed in claim 9.

11. The contact arrangement as claimed in claim 1, wherein the movable one of the inner contact pieces is configured so as to extend beyond its associated outer contact piece in an axial direction by the thickness of the coating.

* * * * *